United States Patent [19]

Menon et al.

[11] 3,958,877

[45] May 25, 1976

[54] HALF-TONE SCREEN WITH CLEANING MEANS FOR AN ELECTROPHOTOGRAPHIC PRINTING MACHINE

[75] Inventors: Sukumaran K. Menon, Webster; Zenon Guran, Rochester, both of N.Y.

[73] Assignee: Xerox Corporation, Stamford, Conn.

[22] Filed: Apr. 10, 1975

[21] Appl. No.: 566,872

[52] U.S. Cl. ..... 355/4; 355/11; 355/67

[51] Int. Cl.[2] ..... G03G 15/22

[58] Field of Search ..... 355/3 R, 4, 11, 17, 355/71, 67; 350/61; 15/21 R, 21 B, 77, 250, 256.5

[56] References Cited

UNITED STATES PATENTS

| | | | |
|---|---|---|---|
| 2,084,292 | 6/1937 | Steiner | 15/250 X |
| 3,120,790 | 2/1964 | Carlson et al. | 355/3 R |
| 3,580,671 | 5/1971 | Lavander | 355/71 X |
| 3,842,273 | 10/1974 | Van Buskirk | 317/262 A X |

*Primary Examiner*—L. T. Hix
*Assistant Examiner*—Kenneth C. Hutchison
*Attorney, Agent, or Firm*—H. Fleischer; C. A. Green; J. J. Ralabate

[57] ABSTRACT

An electrophotographic printing machine in which a screen moves from an inoperative position remote from a photoconductive member employed therein to an operative position closely adjacent thereto. As the screen moves from the operative position to the inoperative position, particles are cleaned therefrom. In addition, the spacing between the screen and photoconductive member is adjustable.

17 Claims, 6 Drawing Figures

HALF-TONE SCREEN WITH CLEANING MEANS FOR AN ELECTROPHOTOGRAPHIC PRINTING MACHINE

BACKGROUND OF THE INVENTION

This invention relates generally to an electrophotographic printing machine, and more particularly concerns removing contaminants from a half-tone image screen operatively associated with a photoconductive member.

In the process of electrophotographic printing, a photoconductive member is charged to a substantially uniform level. A light image of an original document irradiates the charged photoconductive member dissipating selectively the charge thereon in accordance with the intensity thereof. In this way, an electrostatic latent image is recorded on the photoconductive member corresponding to the original document being reproduced. Heat settable particles develop the latent image. These particles are transferred to a sheet of support material, in image configuration. Heat is applied to these particles permanently affixing them to the sheet of support material.

In the process of multi-color electrophotographic printing each of the previous cycles is repeated for a single color. This process requires that the light image be filtered to record an electrostatic latent image corresponding to a single color of the original document. A plurality of different single color light images are created and the resultant single color electrostatic latent images are developed with particles complementary in color to the color of the filtered light image. The particles are then transferred to the sheet of support material in superimposed registration with one another. This multi-layered powder image is then permanently affixed to the sheet of support material by the application of heat thereto producing a permanent color copy of the original document.

Hereinbefore, it has been difficult to create pictorial quality copies in electrophotographic printing machines. The copying machine has great difficulty in forming tone gradations. This problem has been essentially overcome with the utilization of a half-tone screen. This screen produces tone gradations by forming half-tone dots or lines of varying sizes. In the highlight zones, for example, the dots are small. These dots increase in size throughout the intermediate shades until they merge together in the shadow region. In this manner, pictorial quality copies are reproduced in electrophotographic printing machines.

In multi-color electrophotographic printing machines, contaminants such as toner particles and dirt are frequently more numerous than in conventional black and white reproduction machines. This primarily results from the requirement for three differently colored toner particles, i.e., one for each single color electrostatic latent image being developed. These contaminants will frequently accumulate on the screen member degrading copy quality. Thus, it is necessary to clean the screen member periodically to remove excessive contaminants therefrom.

Accordingly, it is the primary object of the present invention to provide an electrophotographic printing machine having an adjustable screen member which is cleaned automatically.

BRIEF SUMMARY OF THE INVENTION

Briefly stated, and in accordance with the present invention, there is provided an electrophotographic printing machine having a photoconductive member.

Pursuant to the features of the present invention, the printing machine includes a screen member mounted movably therein. Means are provided for moving the screen member from an inoperative position remote from the photoconductive member to an operative position closely adjacent thereto. When the screen member is in the operative position, adjusting means control the spacing between the photoconductive member and screen member. As the screen member moves from the operative position to the inoperative position, cleaning means remove particles therefrom.

BRIEF DESCRIPTION OF THE DRAWINGS

Other objects and advantages of the present invention will become apparent upon reading the following detailed description and upon reference to the drawings, in which.

While the present invention will be described in connection with preferred embodiments thereof, it will be understood that it is not intended to limit the invention to these embodiments. On the contrary, it is intended to cover all alternatives, modifications and equivalents as may be included within the spirit and scope of the invention as defined by the appended claims.

DETAILED DESCRIPTION OF THE INVENTION

Figure 1:
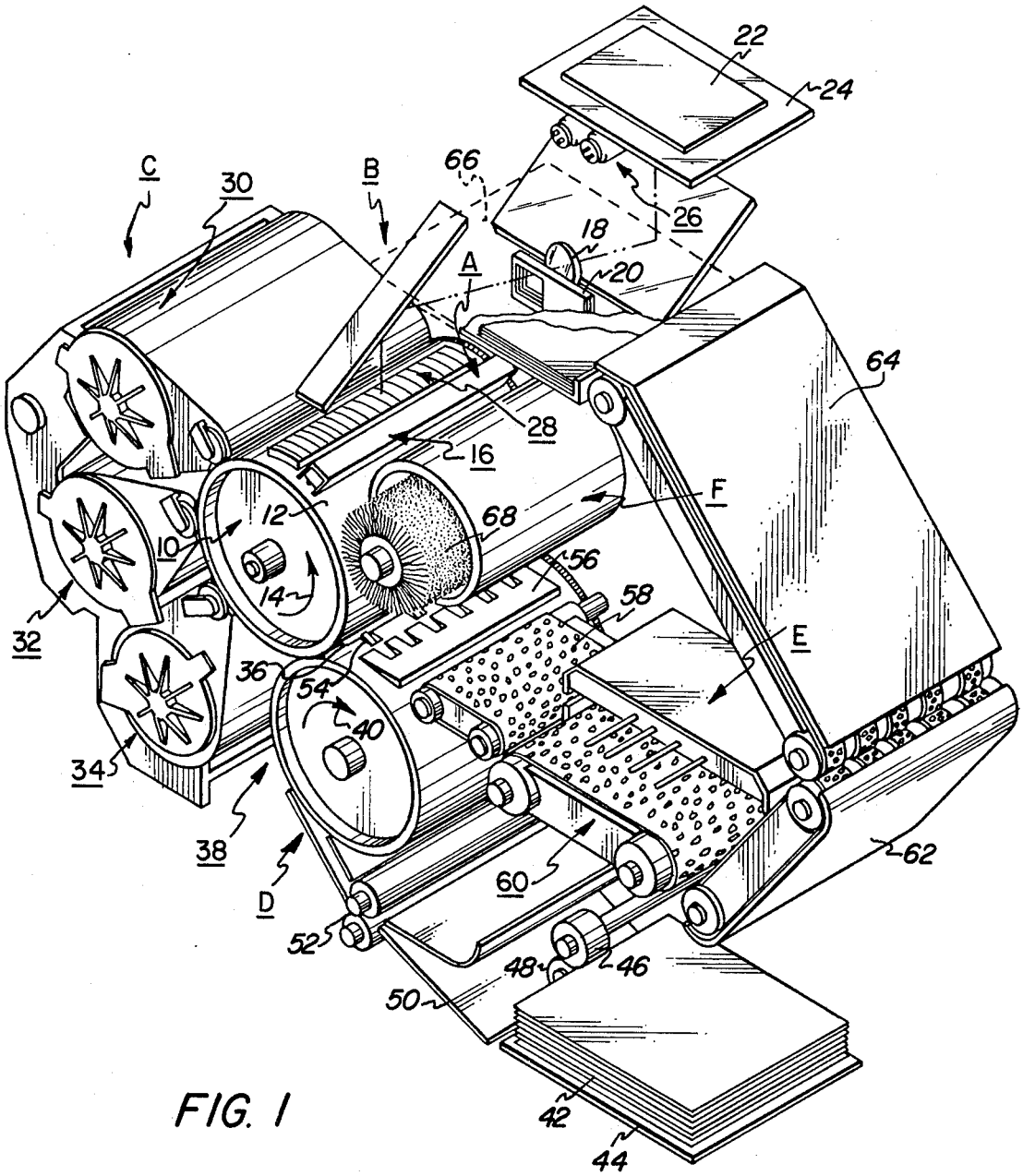
FIG. 1 is a schematic, perspective view depicting an electrophotographic printing machine incorporating the features of the present invention therein.

A general understanding of an electrophotographic printing machine incorporating the features of the present invention therein may be had by referring to FIG. 1. In all the drawings, like reference numerals have been used throughout to designate like elements. The electrophotographic printing machine shown in FIG. 1 reproduces original documents in the form of single sheets, books, or three dimensional objects. While the screening system of the present invention is particularly well adapted for use in an electrophotographic printing machine, it will be evident from the following description that it may be also utilized in many other applications.

As shown in FIG. 1, the electrophotographic printing machine includes a photoconductive member having a rotatable drum 10 with photoconductive surface 12 entrained thereabout and secured thereto. Drum 10 is mounted on a shaft (not shown) and rotates in the direction of arrow 14. This moves photoconductive surface 12 sequentially through a series of processing stations. Preferably, photoconductive surface 12 is made from a suitable polychromatic selenium alloy such as described in U.S. Pat. No. 3,655,377 issued to Sechak in 1972. A timing disc (not shown) is mounted on one end of the shaft of drum 10. The timing disc cooperates with a light source and photosensor to produce electrical pulses which are coupled to the machine logic. In this manner, as drum 10 rotates, the appropriate processing station is activated by the machine logic.

For purposes of the present disclosure, each of the processing stations employed in the electrophotographic printing machine of FIG. 1 will be briefly described hereinafter.

As drum 10 rotates in the direction of arrow 14, it passes through charging station A. Charging station A includes a corona generating device, indicated generally by the reference numeral 16. Corona generating device 16 extends in a longitudinal direction across photoconductive surface 12 and is arranged to produce a spray of ions for the charging thereof. One type of suitable corona generating device is described in U.S. Pat. No. 2,778,946, issued to Mayo in 1957.

Thereafter, drum 10 rotates the charged portion of photoconductive surface 12 to exposure station B. Exposure station B projects a light image of the original document onto the charged portion of photoconductive surface 12. The light image is filtered to produce a single color light image of the original document. Exposure station B includes a moving lens system, generally designated by the reference numeral 18, and a color filter mechanism, shown generally at 20. U.S. Pat. No. 3,062,108, issued to Mayo in 1952, describes a moving lens system suitable for use in electrophotographic printing. A suitable color filter mechanism is described in U.S. Pat. No. 3,775,006 issued to Hartman et al. in 1973. An original document 22 is disposed upon transparent viewing platen 24 and, in conjunction with lens system 19 and filter 20, moves in a timed relationship with drum 10 to scan successive incremental areas of original document 22. Preferably, lens 18 is a six element split dagor type of lens having front and back compound components with a diaphragm located centrally therebetween. The front lens component has three lens elements including in the following order; a first lens element, a second lens element of negative power cemented to the first lens element, and a third lens element of positive power interposed between the second lens element and diaphragm. Preferably, the first lens element has a double convex lens as the front component, a concave lens as the second component, and a convex-concave lens as the third component. The speed of lens 18 ranges from about F/4.5 to about F/8.0. A suitable type of lens is described in U.S. Pat. No. 3,592,531 issued to McCrobie in 1971. In this manner, a flowing light image of original document 22 is produced. This is a single color light image which is transmitted through screen member 28. In one embodiment (FIG. 2), a screen member 28 is interposed into the optical light path. In an alternate embodiment (FIG. 3), screen member 28 is located out of the optical light path. Both of these embodiments will be discussed hereinafter in greater detail with reference to FIGS. 2 and 3. Screen member 28 is mounted pivotably in the printing machine so as to be positioned closely adjacent to photoconductive surface 12 or remote therefrom. When screen member 28 is remote from photoconductive surface 12, a neutral density filter is positioned closely adjacent thereto. The structure for accomplishing the foregoing is shown in greater detail in FIGS. 4 through 6, inclusive.

In operation, the flowing light image passes through screen member 28 to be modulated thereby. In this way, a modulated single color light image irradiates the charged portion of photoconductive surface 12. As indicated hereinbefore, filter mechanism 20 interposes selected color filters into the optical light path. Successive color filters operate on the light rays passing through lens 18 to create modulated single color light images which record modulated single color electrostatic latent images on photoconductive surface 12. The foregoing modulated single color latent images correspond to pre-selected spectral regions of the electromagnetic wave spectrum. Screen member 28 is operational only in the pictorial mode. Contrawise, if the printing machine is in the composition or functional mode, screen member 28 is removed from the optical path and a neutral density filter is inserted therein.

After the electrostatic latent image is recorded on photoconductive surface 12, drum 10 rotates to development station C. At development station C, three individual developer units, generally indicated by the reference numerals 30, 32 and 34, render successive electrostatic latent images visible. A suitable development station employing developer units of this type is described in U.S. Pat. No. 3,854,449, issued to Davidson in 1974. All of the developer units employed in the FIG. 1 electrophotographic printing machine are magnetic brush developer units. In general, a magnetic brush developer unit employs a magnetized developer mix of carrier granules and toner particles. The developer unit forms a directional flux field to continually create a magnetic brush of developer mix. This developer mix brush is brought into contact with the latent image recorded on photoconductive surface 12. The toner particles adhering electrostatically to the carrier granules of the developer mix are attracted by the greater electrostatic force to the latent image, thereby rendering it visible. Developer units 30, 32 and 34, respectively, contain discretely colored toner particles. Each of the toner particles contained in the respective developer unit corresponds to the complement of the single color light images transmitted through each of the different color filters of filter mechanism 20. For example, a latent image formed from a green filtered light image is rendered visible by depositing green absorbing magenta toner particles thereon. Similarly, latent images formed from blue and red light images, are developed with yellow and cyan toner particles, respectively.

After the modulated electrostatic latent images recorded on photoconductive surface 12 is developed, drum 10 rotates to transfer station D. At transfer station D, the toner powder image adhering electrostatically to photoconductive surface 12 is transferred to a sheet of support material 36. Support material 36 is secured releasably to a transfer roll, shown generally at 38. Transfer roll 38 is electrically biased to a potential of a sufficient magnitude and polarity to electrostatically attract toner particles from photoconductive surface 12 to support material 36 secured thereon. Transfer roll 38 rotates in the direction of arrow 40 at substantially the same tangential velocity as drum 10. Thus, as transfer roll 38 rotates in synchronism with drum 10, successive toner powder images may be transferred from photoconductive surface 12 to sheet 38. In this way, a multi-layered toner powder image is formed on the sheet of support material containing substantially the colors of the original document therein. A suitably electrically biased transfer roll is described in U.S. Pat. No. 3,612,677 issued to Langdon, et al. in 1971.

Prior to proceeding with a description of the remaining processing stations, the sheet feeding path will be briefly described. Support material 36 is advanced from stack 42 disposed upon tray 44. Feed roll 46, in operative communication with retard roll 48, separates and advances the uppermost sheet from stack 42. The advancing sheet moves into chute 50 which directs it into the nip of register rolls 52. Register rolls 52 align and forward the advancing sheet, in synchronism with the movement of transfer roll 38. Transfer roll 38 has gripper fingers 54 mounted thereon. Gripper fingers 54 receive the advancing sheets 36 and secure it releasably to transfer roll 38. After the requisite number of toner powder images have been transferred to sheet 36, gripper fingers 54 space sheet 36 from transfer roll 38. As transfer roll 38 continues to rotate, stripper bar 56 is interposed between sheet 36 and transfer roll 38. This separates sheet 36 from transfer roll 38 and moves it onto conveyor 58. Endless belt conveyor 58 moves support material 36 to fixing station E.

At fixing station E, a fuser, indicated generally by the reference numeral 60, supplies heat to the multi-layered toner powder image permanently affixing it to a support material 36. One type of suitable fusing apparatus is described in U.S. Pat. No. 3,826,892 issued to Draugelis in 1974. After the fusing process, sheet 36 is advanced by endless belt conveyors 62 and 64 to catch tray 66 for subsequent removal therefrom by the machine operator.

Frequently, after the transfer process, residual toner particles adhere to photoconductive surface 12. In order to remove these particles, drum 10 rotates photoconductive surface 2 through cleaning station F. Cleaning station F is the final processing station in the direction of rotation of drum 10, as indicated by arrow 4. At this station, the residual toner particles adhering to photoconductive surface 12 are removed therefrom. This is accomplished by a pre-clean corona generating device (not shown) neutralizing the charge on photoconductive surface 12 and that of the residual toner particles. This enable fibrous brush 68, in contact with photoconductive surface 12, to remove the residual toner particles therefrom. A suitable brush cleaning system is described in U.S. Pat. No. 3,590,412, issued to Gerbasi in 1971.

It is believed that the foregoing description is sufficient for purposes of the present application to describe the general features of an electrophotographic printing machine having the present invention incorporated therein.

Figure 2:
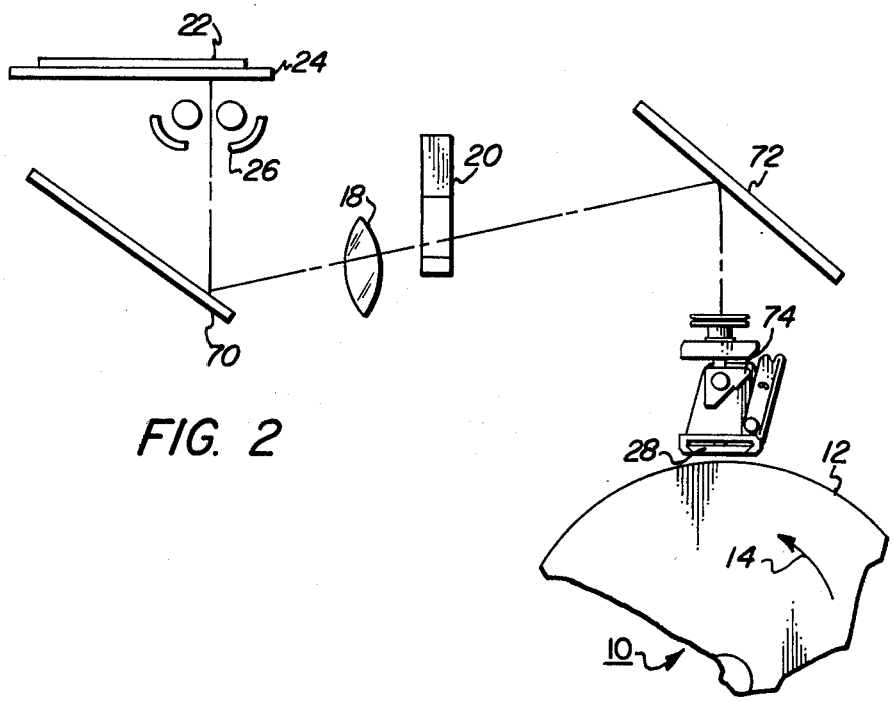
FIG. 2 is an elevational view of one embodiment of the exposure system employed in the FIG. 1 electrophotographic printing machine.

Referring now to FIG. 2, there is shown one embodiment of exposure station B. As shown therein, lamps 26 move across platen 24 with original document 22 being disposed face down thereon. The light rays reflected from original document 22 pass through transparent platen 24 onto mirror 70. Mirror 70 reflects the light rays through lens 18 to form a flowing light image thereof. The flowing light image is then transmitted through the appropriate filter of filter mechanism 20 to produce a single color flowing light image. The single color flowing light image is reflected by mirror 72 through screen member 28 forming a modulated single color flowing light image. Screen member 28 is mounted in housing 74. Housing 74 is arranged to regulate the spacing between screen member 28 and photoconductive surface 12. In addition, housing 74 includes a neutral density filter (FIG. 4) mounted normal to screen member 28. Housing 74 is mounted rotatably within the printing machine such that rotation thereof pivots screen member 28 from a position closely adjacent to photoconductive surface 12 to a position remote therefrom. The detailed structure of housing 74 and the mounting arrangement for screen member 28 and the neutral density filter secured normal thereto, will be described hereinafter in greater detail with reference to FIGS. 4 through 6, inclusive. As the single color light image passing through screen member 28, it is modulated and irradiates the charged portion of photoconductive surface 12. This selectively dissipates the charge on photoconductive surface 12 to record thereon a modulated single color electrostatic latent image.

The foregoing describes the manner of operation when the printing machine is in the pictorial mode. In this mode of operation, contrast may be adjusted by moving screen member 28 to adjust the spacing between photoconductive surface 12 and screen member 28. In the composition or functional mode of operation, screen member 28 is moved out of the optical path so that the light image is not modulated. Alternatively, the spacing may be increased to an optimum distance de-focusing the screen member, thereby rendering it ineffective, i.e. increasing the spacing between the screen and photoconductive member a sufficient distance. Thus, an unmodulated single color light image irradiates the charged photoconductive surface producing a single color electrostatic latent image. Successive single color electrostatic latent images are recorded on photoconductive surface 12 and developed in the manner heretofore described. The resultant powder images are transferred to support material 36 secured to transfer roll 38. These toner powder images are then permanently affixed to the sheet of support material creating a functional copy rather than a pictorial copy of the original document.

It is, therefore, apparent that the prime distinction between the functional copying mode and the pictorial copying mode resides in the usage or non-usage of the screen. In a pictorial copy mode, the screen member modulates light image producing a pictorial copy. Contrawise in the functional copying mode, the screen member is ineffective and the light image is unmodulated resulting in a functional copy. Still a third mode of operation is the composition mode. In this mode of operation, the screen member is ineffective, however, a screen is positioned on platen 24 masking selected portions of the original document. Thus, the platen screen only covers those portions of the original document that are pictorial, whereas the functional portions of the original document remain unscreened.

Mode selection is an operator function. By this, it is meant that the operator by pressing a button marked "functional, composition of pictorial" selects the mode of operation. If the operator selects the functional or composition mode of operation, housing 74 moves screen member 28 to an inoperative position and interposes a neutral density filter therein. Contrawise, the screen member is interposed into the optical path closely adjacent to the photoconductive member in the pictorial mode of operation.

In addition to these controls, a contrast control is contained within the printing machine. The contrast control operates in the pictorial mode to permit the machine operator to regulate the spacing between screen member 28 and photoconductive surface 12. This, in turn, adjusts the contrast of the pictorial copy reproduced thereby.

Figure 3:
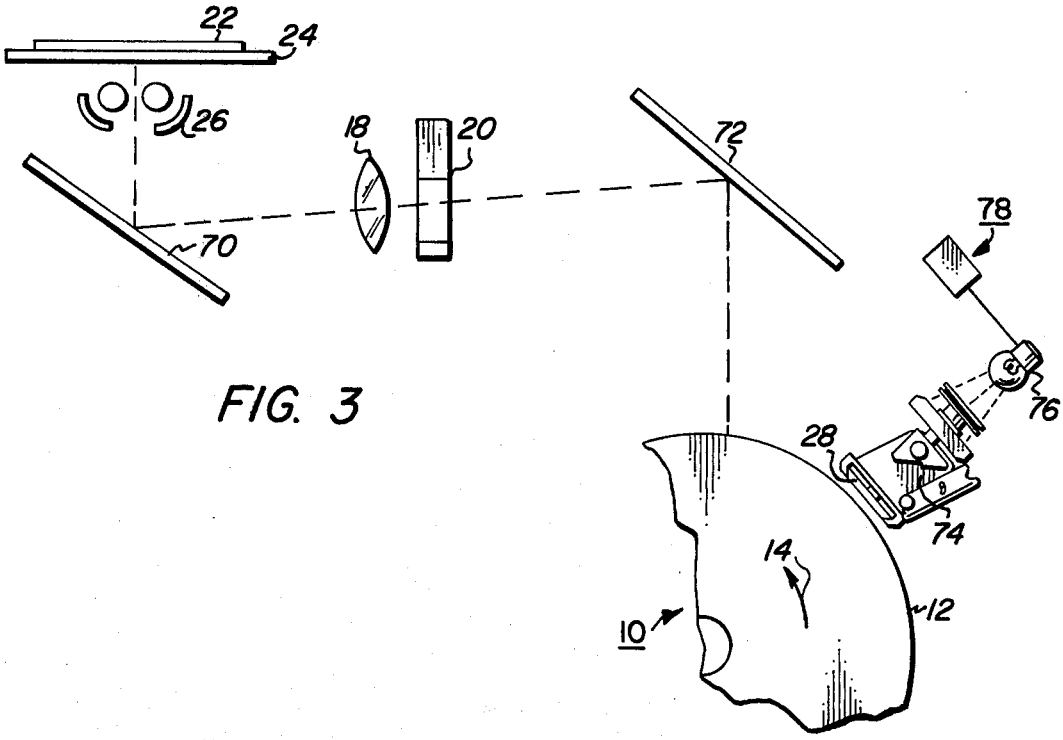
FIG. 3 is an elevational view of another embodiment of the exposure system employed in the FIG. 1 printing machine.

Referring now to FIG. 3, there is shown another embodiment of exposure station B. As depicted therein, screen member 28 is positioned prior to the optical light image path. It should be noted that in this mode of operation, the screen member may be located either prior to or subsequent to the light image path as shown by arrow 14 indicating the direction of rotation of drum 10. Once again, lamps 26 move across platen 24 scanning original document 22. The light rays reflected from original document 22, are, in turn, reflected by mirror 70 through lens 18 forming a flowing light image. This flowing light image passes through the corresponding filter of filter mechanism 20 forming a single color flowing light image. This single color flowing light image is reflected in a downwardly direction by mirror 72 onto photoconductive surface 12. The flowing light image irradiates the portion of photoconductive surface 12 having the screen pattern recorded thereon. In the event that the screen is located after the formation of the flowing light image, the screen light pattern will be projected in superimposed registration with the latent image of the original document recorded on photoconductive surface 12. The screen pattern is formed by irradiating screen member 28 with light rays from a light source or lamp 76. The screen light rays irradiate the charged portion of photoconductive surface 2 prior to or subsequent to the formation of the electrostatic latent image of the original document. Spacing between screen member 28 and photoconductive surface 12, may be adjusted by the apparatus within housing member 74 hereinafter to be described with reference to FIGS. 4 through 6, inclusive. Adjustment of the spacing regulates the contrast of the resultant copy. Light source 76 projects light rays through screen member 28 forming a screen pattern on photoconductive surface 12. This screen pattern moves in the direction of arrow 14 and the flowing light image of the original document is projected thereon in superimposed registration therewith. Thus, the resultant composite electrostatic latent image formed on photoconductive surface 12 is modulated. This is an additive optical exposure rather than a multiplicative optical exposure as is shown in FIG. 2. In the pictorial mode of operation, screen member 28 and light source 76 are operational. Light source 76 is excited by a voltage source 78. In order to place the copying machine in the functional mode of copying, voltage sources 78 is de-energized and light source 76 is deactivated. In this manner, light rays are not projected through a screen member 28 and a screen pattern is not formed on photoconductive surface 12. Thus, the single color flowing light image irradiates the charged portion of photoconductive surface 12 recording an unmodulated single color electrostatic latent image thereon.

Figure 4:
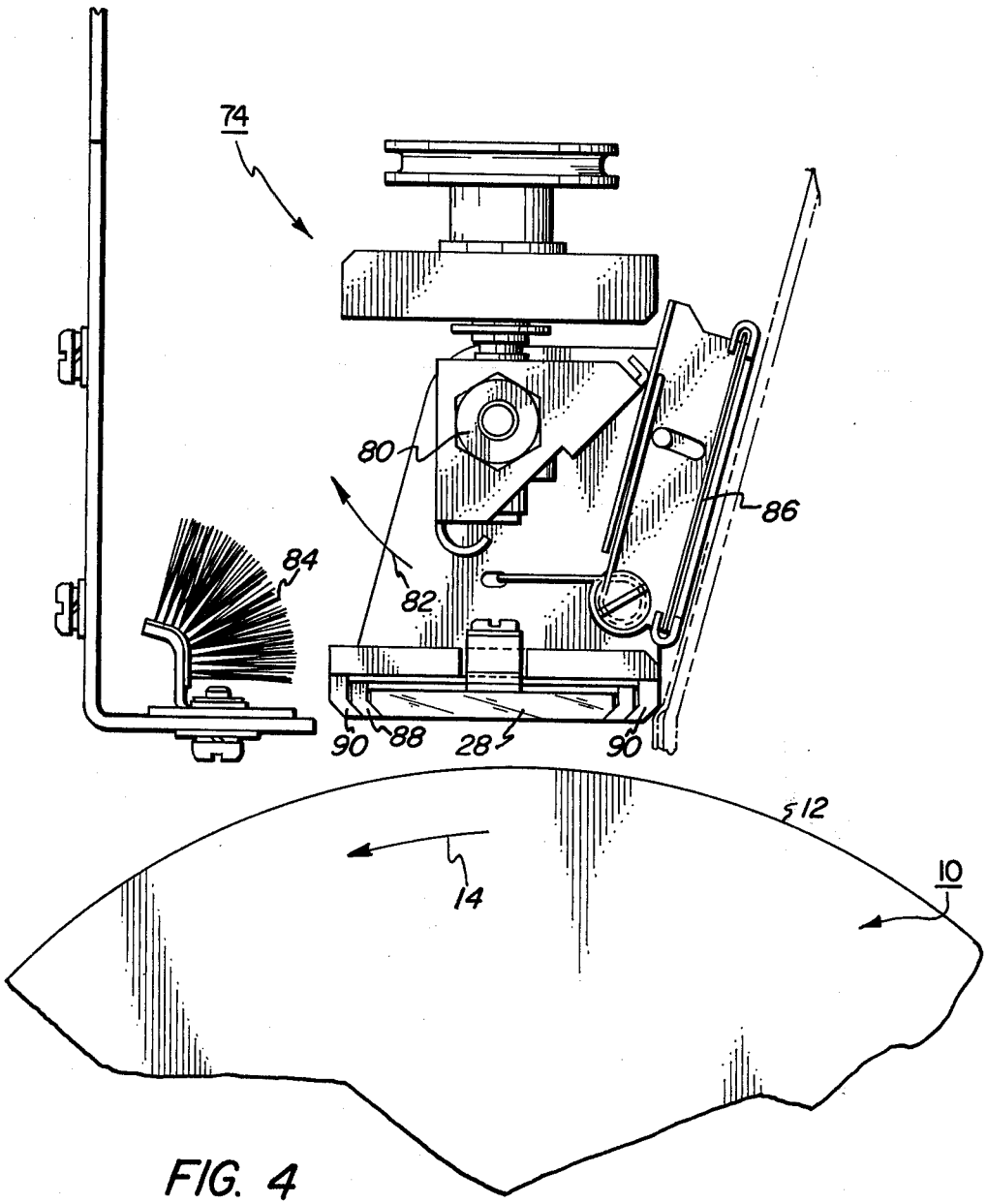
FIG. 4 is an elevational view of the mechanism for cleaning the screen member employed in the FIG. 1 printing machine to an inoperative position remote therefrom.

Referring to FIG. 4, the detailed structure of housing member 74 will now be described. Screen member 28 is mounted in an open ended slot 88 of housing 74. Housing 74 is mounted by a suitable pin and bolt arrangement 80 pivotably to the printing machine frame. Actuation of a motor (not shown) rotates housing 74 in the direction of arrow 82. As housing 74 pivots in the direction of arrow 82, screen member 78 moves from the operative position to the inoperative position. As screen member 28 moves from the operative position, it contacts cleaning means or brush 84. Brush 84 extends across the entire surface of screen 28 and removes any residual particles adhering thereto. Preferably, brush 84 is a fibrous brush made from Dynel. When screen member 28 is positioned in the inoperative position, neutral density filter 86 is in the operative position. Screen member 28 is mounted in slot 88 and secured therein by lips 90.

Figure 5:
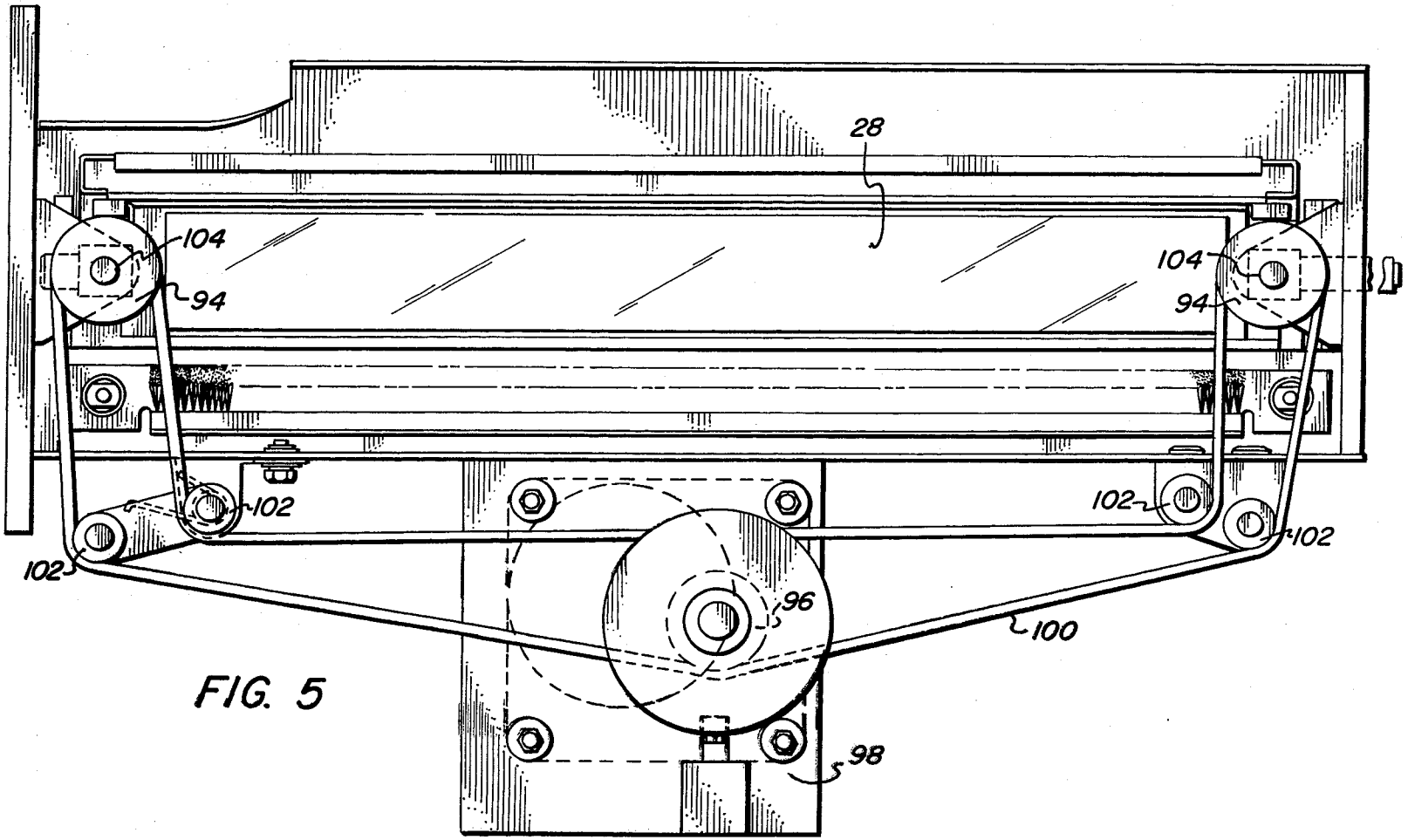
FIG. 5 is a plan view depicting the mechanism for adjusting the spacing between the screen member and photoconductive member.

Turning now to FIG. 5, the mechanism for moving screen member 28 relative to drum 10 will now be described. Movement of screen member 28 adjusts the spacing between screen member 28 and photoconductive surface 12 of drum 10. Geared pulleys 94 attached to threaded shafts support screen member 28. Endless belt 100 driven by pulley 96 attached to motor 98 moves both ends of screen member 28 an equal distance. This insures that the spacing between photoconductive surface 12 of drum 10 and screen member 28 is uniform thereacross. Idler pulleys 102 are mounted movably in housing 78 to adjust the tension in belt 100.

Figure 6:
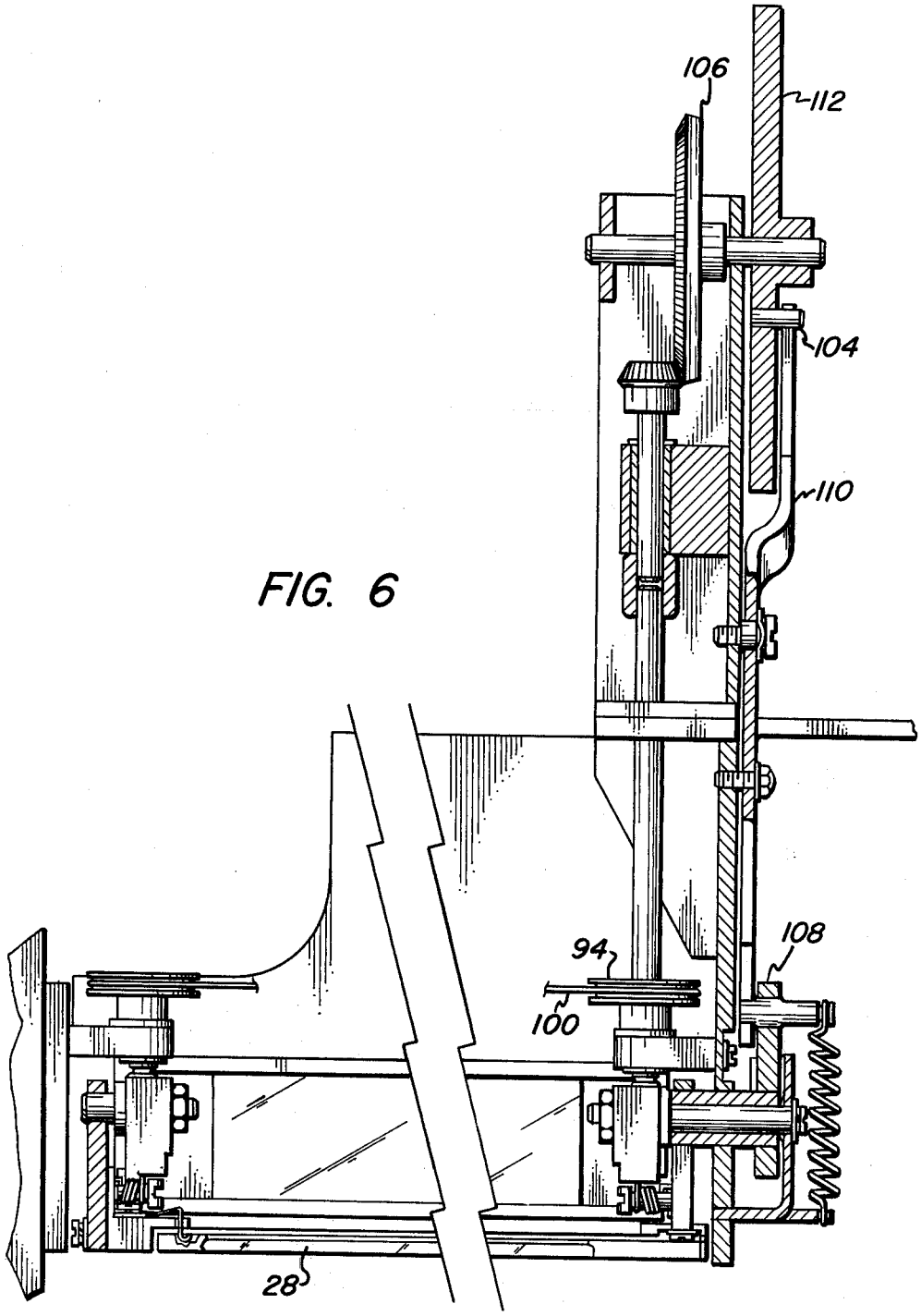
FIG. 6 is an elevational view of the FIG. 5 mechanism.

As shown in FIG. 6, rotating geared pulley 94 raises or lowers screen member 28. When pulley 94 continues to rotate in a direction to raise screen member 28, pin 104 driven by bevel gear 106 actuates arm 108 through linkage 110, thereby pivoting screen member 28 out of the optical path and moving neutral density filter 86 (FIG. 4) into the optical light path. Alternatively, screen member 28 may be moved out of the optical path and have the spacing between itself and photoconductive surface 12 of drum 10 adjusted manually. This may be achieved by turning dial 110 through an angle less than 360°. In the manual mode, the motor is decoupled from the system. Thus, screen member 28 is initially spaced a greater distance from photoconductive surface 12 of drum 10, and, thereafter, pivoted away from the optical path by pin 104, gear 106, arm 108 and linkage 110. As screen member 28 pivots to the inoperative position, it contacts brush 84 to remove contaminants thereon.

In recapitulation, it is evident that the apparatus of the present invention cleans the screen member as it moves from the operative position closely adjacent to the photoconductive surface to the inoperative position remote therefrom. Cleaning is achieved by a brush contacting the screen member as it rotates from the operative position to the inoperative positions. Movement of the screen to the inoperative position positions a neutral density filter in the operative position. In addition, the spacing between the photoconductive surface and screen member may be readily adjusted so as to control contrast of the resultant copy.

It is, therefore, apparent that there has been provided, in accordance with the present invention, an electrophotographic printing machine that fully satisfies the objects, aims and advantages hereinbefore set forth. While the present invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. An electrophotographic printing machine of the type having a photoconductive member, including:

a screen member mounted moveably in the printing machine;

mean for moving said screen from an inoperative position remote from the photoconductive member to an operative position closely adjacent thereto;

means, responsive to said screen member being in the operative position, for adjusting the spacing between the photoconductive member and said screen member; and means for cleaning particles from said screen member as said screen member moves from the operative position to the inoperative position.

2. A printing machine as recited in Claim 1, further including:

means for charging the photoconductive member to a substantially uniform potential; and means for projecting a light image of an original document through said screen member onto the charged portion of the photoconductive member discharging selectively the charge to record thereon a modulated electrostatic latent image.

3. A printing machine as recited in claim 2, wherein said projecting means includes means for filtering successive light images with differently colored filters so as to record successive modulated single color electrostatic latent images on the photoconductive member.

4. A printing machine as recited in claim 3, further including:

means for developing each single color electrostatic latent image with charged particles complementary in color to the color of the corresponding single color light image;

means for transferring successive differently colored charged particles to a sheet of support material in superimposed registration with one another; and means for permanently affixing the differently colored charged particles to the sheet of support material forming a colored copy of the original document.

5. A printing machine as recited in claim 4, further including a neutral density filter arranged to move from an inoperative position remote from the light image path to an operative position interposed in the path of the light image in response to said screen member moving from the operative position to the inoperative position thereof.

6. A printing machine as recited in claim 5, wherein said cleaning means includes a brush positioned to contact said screen member as said screen member moves from the operative position to the inoperative position.

7. A printing machine as recited in claim 6, wherein said moving means includes a housing member mounted pivotably in the printing machine, said housing member having mounted thereon said screen member and said neutral density filter with a plane defined by said screen member being substantially normal to a plane defined by said neutral density filter so that as said housing member rotates said screen member from the operative position to the inoperative position, said neutral density filter rotates from the inoperative position to the operative position.

8. A printing machine as recited in claim 7, wherein said screen member includes a transparent sheet having a plurality of substantially equally spaced opaque lines thereon.

9. A printing machine as recited in claim 7, wherein said screen member includes a transparent sheet having a plurality of substantially equally spaced opaque dots thereon.

10. A printing machine as recited in claim 1, further including:

means for charging the photoconductive member to a substantially uniform potential;

a light source for illuminating said screen member to irradiate the charged portion of the photoconductive member recording thereon a screen pattern; and means for projecting a light image of an original document onto the charged portion of the photoconductive member recording thereon an electrostatic latent image such that the screen pattern and electrostatic latent image are in superimposed registration with one another.

11. A printing machine as recited in claim 10, wherein said projecting means includes means for filtering successive light images with differently colored filters so as to record succesive modulated single color electrostatic latent images on the photoconductive member.

12. A printing machine as recited in claim 11, further including:

means for developing each single color electrostatic latent images with charged particles complementary in color to the color of the corresponding single color light image;

means for transferring successive differently colored charged particles to a sheet of support material in superimposed registration with one another; and means for permanently affixing the differently colored charged particles to the sheet of support material forming a color copy of the original document.

13. A printing machine as recited in claim 12, wherein said cleaning means includes a brush positioned to contact said screen member as said screen member moves from the operative position to the inoperative position.

14. A printing machine as recited in claim 13, wherein said moving means includes a housing member mounted pivotably in the printing machine, said housing member having mounted thereon said screen member so that pivoting said housing member moves said screen member from the operative position to the inoperative position.

15. A printing machine as recited in claim 14, further including:

a voltage source for energizing said light source; and means for controlling said voltage source so that a screen pattern is recorded in the photoconductive member in response to said light source being energized.

16. A printing machine as recited in claim 15, wherein said screen member includes a transparent sheet having a plurality of substantially equally spaced opaque lines thereon.

17. A printing machine as recited in claim 15, wherein said screen member includes a transparent sheet having a plurality of substantially equal spaced opaque dots thereon.

* * * * *